US008334865B2

(12) United States Patent
Lin et al.

(10) Patent No.: US 8,334,865 B2
(45) Date of Patent: Dec. 18, 2012

(54) METHOD AND RELATED APPARATUS FOR IMPROVING IMAGE QUALITY OF LIQUID CRYSTAL DISPLAY DEVICE

(75) Inventors: I-Ping Lin, Hsinchu (TW); Ting-Yun Huang, Tainan County (TW); Chia-Yin Chiang, Hsinchu County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 842 days.

(21) Appl. No.: 12/494,251

(22) Filed: Jun. 29, 2009

(65) Prior Publication Data

US 2010/0231604 A1 Sep. 16, 2010

(30) Foreign Application Priority Data

Mar. 16, 2009 (TW) ..... 98108392 A

(51) Int. Cl.
*G09G 5/02* (2006.01)

(52) U.S. Cl. ..... 345/212; 345/89; 345/96; 345/209; 345/211; 345/690

(58) Field of Classification Search ..... 345/87–96, 345/204–215, 690
See application file for complete search history.

(56) References Cited

U.S. PATENT DOCUMENTS

2011/0242085 A1* 10/2011 Tsuchi ..... 345/212
2012/0026154 A1* 2/2012 Tsuchi ..... 345/212

FOREIGN PATENT DOCUMENTS

CN 101388190 A 3/2009
CN 101661724 A 3/2010

* cited by examiner

*Primary Examiner* — Vijay Shankar
(74) *Attorney, Agent, or Firm* — Winston Hsu; Scott Margo

(57) ABSTRACT

A method for improving an image quality of a liquid crystal display (LCD) device includes receiving an input image, generating a plurality of consecutive pictures of a predefined period number according to the input image, wherein a gray level of the input image is greater than a gray level of the plurality of contiguous pictures, setting a number of pixels required for adding a value among the plurality of contiguous pictures for every display element according to a least significant bits (LSB) of a pixel of the input image, and enforcing the number of add-value pixels of a positive polarity closes the number of add-value pixels of a negative polarity according to the number of add-value pixels in each of the plurality of consecutive pictures and the polarity of the corresponding display element.

21 Claims, 17 Drawing Sheets

METHOD AND RELATED APPARATUS FOR IMPROVING IMAGE QUALITY OF LIQUID CRYSTAL DISPLAY DEVICE

BACKGROUND OF THE INVENTION

1. Field of the Invention

The present invention is related to a method and related apparatus capable of improving image quality of a liquid crystal display device, and more particularly, to a method and related apparatus which can reduce flickering phenomena and increase the grey levels of the liquid crystal display device.

2. Description of the Prior Art

As technology advances, not only the functions of various IT products become even more complicated, but their designs are also becoming slimmer and of less weight. At the same time, many popular products, like the wireless phone, the personal data assistant (PDA) and the video game controller are using a liquid crystal display (LCD) device as the apparatus to present visual information. Compared with other kinds of display device, the LCD device has several advantages like light weight, thin thickness and reasonable price. At present, for the handheld or portable IT product, few other display technologies may challenge the dominant role of the LCD devices.

Please refer to FIG. 1, which illustrates a schematic diagram of display elements located in a liquid crystal display device 10 according to the prior art. Generally, the liquid crystal display device 10 comprises a large number of display elements or pixels lined up as multiple columns and rows. Furthermore, a color display element is to overlay a display element with a color filter selected from the well-known three primary colors, which are red, green and blue, respectively; then, various kinds of colors can be realized by combining the lights outputted from the neighboring display elements of three primary colors. When the grey levels increase for each of the display elements, the total number of colors which can be displayed will be increased to the third power. For example, if the total grey levels of each display elements are equal to and can be represented by an 8-bit digital number, which corresponds to 256 grey levels, then the total number of colors which can be displayed by the three display elements of three primary colors would theoretically amount to 256*256*256 (=16,777,216).

For every display element, there exists a proprietary electrode, which is used for applying a voltage signal to control the optical characteristics of the liquid crystal of the display element; that is to say, by controlling the voltage of the electrode, the liquid crystal of the display element can modulate the polarization angle of the incoming light, such that the display element can behave as an optical switch. By taking the normally black liquid crystal display device as an example, when the voltage difference between the proprietary electrode and the common electrode increases, the light transmittance of the display element will be increased according to the voltage difference. Therefore, when a pixel data is input to the liquid crystal display device 10, the liquid crystal display device 10 can adjust the voltage of the proprietary electrode of each display element according to the value of the pixel data corresponding to the display element. For every display element in the panel, this process can be repeated to respectively control the light transmittance of each display element in the panel, and eventually a whole image can be presented. In other words, the liquid crystal display device 10 displays the image by controlling voltages of the proprietary electrode of the display element according to the data value in the incoming image. Meanwhile, the grey levels of different types of liquid crystal display device may not the same. Normally, the grey levels of the liquid crystal display device could vary from 4 bits to 8 bits. In general, from an ordinary customers' point of view, it has been widely recognized that the less the grey levels, the worse the image quality.

On the other hand, the number of bits of the incoming display data can be different. When the number of bits of the display data is greater than the number of bits which can be displayed by the display elements, according to the prior art, some display devices just simply discard the least significant bits of the display data, such that the truncated data can fit the data width of the display device and then can be displayed by the display devices. However, by doing so, the image quality can be sacrificed.

Furthermore, the display element should be able to constantly switch the polarity of its proprietary electrode relative to a common electrode, and this is very important and essential for the liquid crystal material in a display element to keep functioning normally. The method of switching the polarity of the display element is to switch the voltage of the proprietary electrode alternatively between a positive voltage and a negative voltage (relative to the common electrode), such that the liquid crystal material will not experience an irreversible change, and permanently destroys its function as an optical switch. Please refer to FIG. 2A and FIG. 2B, which illustrates a schematic diagram of a dot inversion liquid crystal display device 20 and the polarity distribution of display elements thereof. Inside FIG. 2A and FIG. 2B, the plus sign (+) means the polarity of the display element is of positive polarity, and the negative sign (−) is of the negative polarity. All the display elements should be able to switch between these two polarities. Normally, the display element should be able to switch the polarity of the display element for every new frame of data. For example, the polarity distribution of the dot inversion liquid crystal display device 20 is taking a single display element as a group, and any display element (group) DE_x,y must have its polarity opposite to the four neighboring display elements (groups). Noteworthily, the polarity distribution of the display elements of a panel will heavily depend on the original design of the liquid crystal display device. For example, please refer to FIG. 3A, which illustrates a schematic diagram of a two-dot inversion liquid crystal display device 30 and display elements thereof. The most distinguished feature of the two-dot inversion liquid crystal display device 30 is that any trace from the source driver (exampled and denoted as S1~S3 in FIG. 3A) can supply up to two columns of display elements with the display data; the odd-numbered and the even-numbered traces from the gate driver (exampled and denoted as G1~G7 in FIG. 3A) are designed to activate alternatively, so the display data can be written into the display elements in a seamless way. Please refer to FIG. 3B and FIG. 3C, which illustrate schematic diagrams of a two-dot inversion liquid crystal display device 30 and the polarity distribution of display elements thereof. The two-dot inversion liquid crystal display device 30 often utilizes the dual gate structure, such that two neighboring display elements of the same polarity can be taken as a group DEG_x,y. The display elements belonging to the same group DEG_x,y keeps the same polarity, and the polarity of the group is opposite to the polarities of its four neighboring groups. Besides, on the boundary portion of the two-dot inversion liquid crystal display device 30, it may have a polarity distribution where only one display element becomes a group. Please refer to FIG. 3D and FIG. 3E, which illustrate schematic diagrams of the two-dot inversion liquid crystal display device 30 with irregular polarity distribution on the boundary of the LCD panel.

SUMMARY OF THE INVENTION

It is therefore the primary objective of the claimed invention to provide a a method and related apparatus capable of improving image quality of liquid crystal display device.

The present invention discloses a method for improving an image quality of a liquid crystal display (LCD) device, a panel of the LCD device having a plurality of display elements each switching between a positive polarity and a negative polarity, the method comprising receiving an input image comprising a plurality of input image sub-pixels corresponding to a plurality of display elements; generating a plurality of consecutive pictures of a predefined period number according to the input image, wherein a gray level of the input image is greater than a gray level of the plurality of contiguous pictures; setting a number of pixels required for adding a value among the plurality of consecutive pictures for every display element according to a least significant bits (LSB) of a pixel of the input image; and enforcing the number of add-value pixels of a positive polarity to be close to the number of add-value pixels of a negative polarity according to the number of add-value pixels in each of the plurality of contiguous pictures and the polarity of the corresponding display element.

The present invention further discloses an image processor for improving an image quality of a liquid crystal display (LCD) device, a panel of the LCD device having a plurality of display elements each switching between a positive polarity and a negative polarity, the image processor comprising an input unit, for receiving an input image comprising a plurality of input image sub-pixels corresponding to a plurality of display elements; a preprocessing unit, for generating a plurality of consecutive pictures of a predefined period number according to the input image, wherein a gray level of the input image is greater than a gray level of the plurality of consecutive pictures; an add-value switching unit, for setting a number of pixels required for adding a value among the plurality of contiguous pictures for every display element according to a least significant bits (LSB) of a pixel of the input image; and a polarity switching unit, for enforcing the number of add-value pixels of a positive polarity to be close to the number of add-value pixels of a negative polarity according to the number of add-value pixels in each of the plurality of contiguous pictures and the polarity of the corresponding display element.

The present invention further discloses a liquid crystal display (LCD) device comprising a panel comprising a plurality of display elements each switching between a positive polarity and a negative polarity; and an image processor comprising an input unit, for receiving an input image comprising a plurality of input image sub-pixels corresponding to a plurality of display elements; a preprocessing unit, for generating a plurality of consecutive pictures of a predefined period number according to the input image, wherein a gray level of the input image is greater than a gray level of the plurality of consecutive pictures; an add-value switching unit, for setting a number of pixels required for adding a value among the plurality of consecutive pictures for every display element according to a least significant bits (LSB) of a pixel of the input image; and a polarity switching unit, for enforcing the number of add-value pixels of a positive polarity to be close to the number of add-value pixels of a negative polarity according to the number of add-value pixels in each of the plurality of consecutive pictures and the polarity of the corresponding display element.

These and other objectives of the present invention will no doubt become obvious to those of ordinary skill in the art after reading the following detailed description of the preferred embodiment that is illustrated in the various figures and drawings.

DETAILED DESCRIPTION

Generally speaking, because of different structures and design principles being used for the liquid crystal display devices, different liquid crystal display devices may have different polarity distributions, and the polarity distribution of an LCD device may interact with the display data of the incoming image, and generate some unpleasant visual effects, such as flickers. The present invention is for generating display images with more grey levels on an LCD device and can reduce the flickers on the image by utilizing the polarity distribution of the LCD device.

Figure 4:
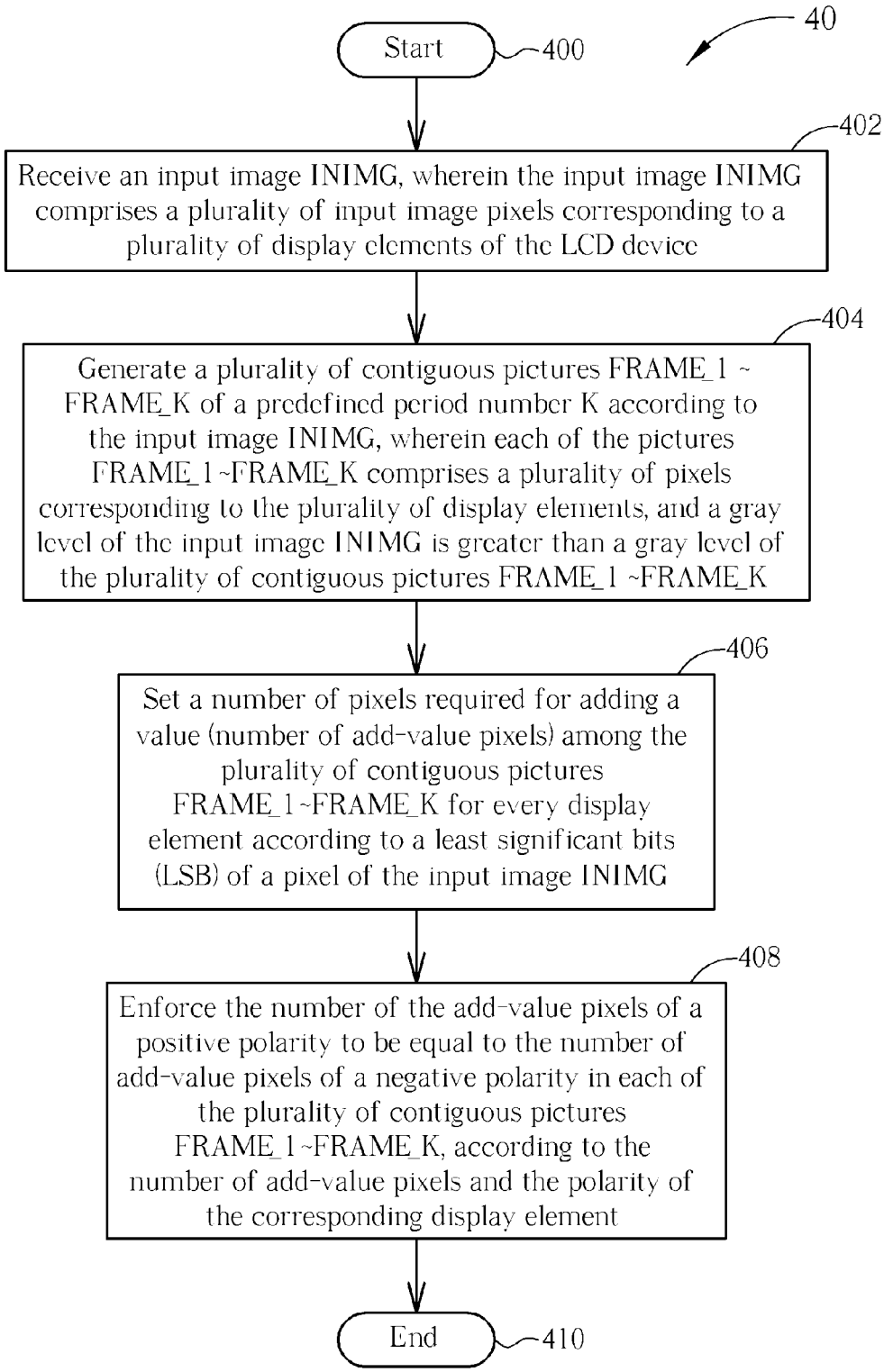
FIG. 4 illustrates an image display method of an LCD device according to an embodiment of the present invention.

Please refer to FIG. 4, which illustrates an image display method 40 of an LCD device according to an embodiment of the present invention. The image display method 40 can visually increase the grey levels of the LCD device, and comprises the following steps:

STEP 400: Start.

STEP 402: Receive an input image INIMG, wherein the input image INIMG comprises a plurality of input image pixels corresponding to a plurality of display elements of the LCD device.

STEP 404: Generate a plurality of consecutive pictures FRAME_1~FRAME_K of a predefined period number K according to the input image INIMG, wherein each of the pictures FRAME_1~FRAME_K comprises a plurality of pixels corresponding to the plurality of display elements, and a gray level of the input image INIMG is greater than a gray level of the plurality of consecutive pictures FRAME_1~FRAME_K.

STEP 406: Set a number of pixels required for adding a value (number of add-value pixels) among the plurality of consecutive pictures FRAME_1~FRAME_K for every display element according to a least significant bits (LSB) of a pixel of the input image INIMG.

STEP 408: Enforce the number of the add-value pixels of a positive polarity to be close to the number of add-value pixels of a negative polarity in each of the plurality of consecutive pictures FRAME_1~FRAME_K, according to the number of add-value pixels and the polarity of the corresponding display element.

STEP 410: End.

According to the present invention, after receiving an input image INIMG, the operating principles of the image display method 40 generates pictures FRAME_1~FRAME_K according to the input image INIMG, wherein both the input image pixels of the input image INIMG and the pixels of pictures FRAME_1~FRAME_K correspond to the display elements of the LCD device. Furthermore, the present invention sets the number of pixels required for adding a value (number of add-value pixels) for every display element among pictures FRAME_1~FRAME_K according to the least significant bits (LSB) of the pixel value of the input image INIMG. Finally, the present invention enforces the number of the add-value pixels of a positive polarity to be close to the number of add-value pixels of a negative polarity, according to the number of add-value pixels in each picture of the pictures FRAME_1~FRAME_K and the polarity of the corresponding display element.

Simply speaking, the present invention takes every display element on the LCD device as an image point in a two dimensional coordinate system, every image point in the coordinate corresponds to an input image pixel in the input image INIMG and a total of K pixels (of the same coordinate) are in the pictures FRAME_1~FRAME_K, respectively. Furthermore, for every point (display element), the present invention will utilize the least significant bits (LSB) of the input image pixel of the input image INIMG to determine and set the number of pixels required for adding a value for the K pixels of the same coordinate for each of the pictures FRAME_1~FRAME_K. And, the present invention will utilize the polarity of the display elements such that the number of the add-value pixels of the positive polarity to be close to the number of add-value pixels of the negative polarity for each of the pictures FRAME_1~FRAME_K.

In other words, the present invention uses the add-value pixels to display the least significant value of the grey level of the pixel in the temporal domain; meanwhile, in the spatial domain, the present invention will arrange the position of the add-value pixels according to the polarity of the display element. By this process, the present invention can not only increase the grey levels of the pixel for a specific number of bits, but also reduce the flicker phenomena by enforcing the spatial distribution of the add-value pixels according to the polarity of the display elements.

As mentioned above, the present invention is to enforce the number of the add-value pixels to be close to the value of the least significant bits (LSB). In principle, according to the averaging effect of the human eyes for fast moving pictures, the pixels displayed with more add-value pixels, the light intensity of the pixels will be slightly higher. On the contrary, if the number of the add-value becomes less, the pixels will be display with slightly lower intensity.

For example, when the input image pixel of the input image INIMG is an 8-bit binary data, and the display capacity of the LCD panel can accept and display only 6-bit of data, according to the prior art, the 2 least significant bits (LSB) of the input image pixel are discarded directly, and the data after truncating the LSBs are then directed into the LCD panel to display. For example, if the input image pixel is an 8-bit binary data of value $11001011_2$, the data after truncating the LSBs becomes $110010_2$, the 2 least significant bits ($11_2$) is discarded directly. On the other hand, according to the image display method 40 of the present invention, to display the 8-bit data with 6-bit LCD panel, 4 consecutive pictures can be used to display the grey level of $11001011_2$ by a sequence like $110011_2$, $110010_2$, $110011_2$ and $110011_2$ of display data for the corresponding display element, wherein the $110011_2$ happens 3 times in the display sequence, and $110010_2$ happens for just one time in the same display sequence. Similarly, to display the grey level of $11001010_2$, the $110011_2$ happens for 2 times in the display sequence, and $110010_2$ also happen 2 times in the same display sequence. In other words, the image display method 40 is to explore more bits in the grey levels for the display device of limited display capability, and determine the number of add-value pixels according to the least significant bits of the input data. In the above example, the value $110011_2$ is the so-called the pixel value of the add-value pixels, the frequency of appearance of these add-value pixels must correspond to the value of the originally discarded least significant bits.

Noteworthily, if the add-value pixels happens all the time in the sequence of the pictures FRAME_1~FRAME_K, it is equivalent to display the intensity of a greater grey level which is originally included in the LCD device. On the contrary, if there is no add-value pixel in the sequence of the pictures, then it is equivalent to display the intensity of the original grey level. Therefore, by applying the present invention, the number of newly generated grey levels will be no more than the number K of the contiguous pictures FRAME_1~FRAME_K minus 1. For example, if K equals 4, the amount of newly generated grey levels will be no more than 3, and it is corresponding to the three LSB values of $01_2$, $10_2$ and $11_2$ in the above example.

Meanwhile, also according to the image display method 40, the number of the add-value pixels of the positive polarity is made to be close to the number of add-value pixels of the negative polarity in every picture of the consecutive pictures FRAME_1~FRAME_K. Preferably, by applying this function, each of the pictures FRAME_1~FRAME_K is first divided into image blocks Block_1~Block_n. And, for an image block Block_x of the image blocks Block_1~Block_n, the number of the add-value pixels of the positive polarity is made to be closed to the number of add-value pixels of the negative polarity According to the experiment, by applying the image display method 40, the grey levels can be increased owing to the visual averaging effect to fast moving picture, and in the spatial domain, by equally assigning the add-value pixels to the positive polarity and to the negative polarity, the image flickering will be canceled.

Besides, preferably, if the grey levels are all equal for every pixels in image block Block_x, then for every picture in the consecutive pictures FRAME_1~FRAME_K, the image display method 40 can enforce the number of add-value pixels to be equally distributed for every image block Block_x of the consecutive pictures FRAME_1~FRAME_K, such that the pixel intensity of the pictures FRAME_1~FRAME_K can be displayed in a more stable way. In other words, during the process of displaying the pictures FRAME_1~FRAME_K, the present invention can avoid the number of add-value pixels to be varied unwillingly by enforcing the number of add-value pixels to be all equal in the image block Block_x while displaying the pictures FRAME_1~FRAME_K. For example, if the image block has 16 pixels, and the number K of the pictures FRAME_1~FRAME_K equals 4, and then the number of newly generated grey levels will be equal to 3. If the discarded LSB are $01_2$, then the add-value pixels in the BLOCK_x of every picture in FRAME_1~FRAME_4 will be equal to 4 (16÷4×1). Similarly, if the discarded LSB are 102 then the add-value pixels in the BLOCK_x of every picture in FRAME_1~FRAME_4 will be equal to 8 (16÷4×2). And, if the discarded LSB are $11_2$ then the add-value pixels in the BLOCK_x of every picture in FRAME_1~FRAME_4 will be equal to 12 (16÷4×3). By doing so, the pixels which are designated as add-value pixels will be equally distributed in every picture in FRAME_1~FRAME_K, so the performance for displaying moving pictures can be further optimized.

Figure 5A:
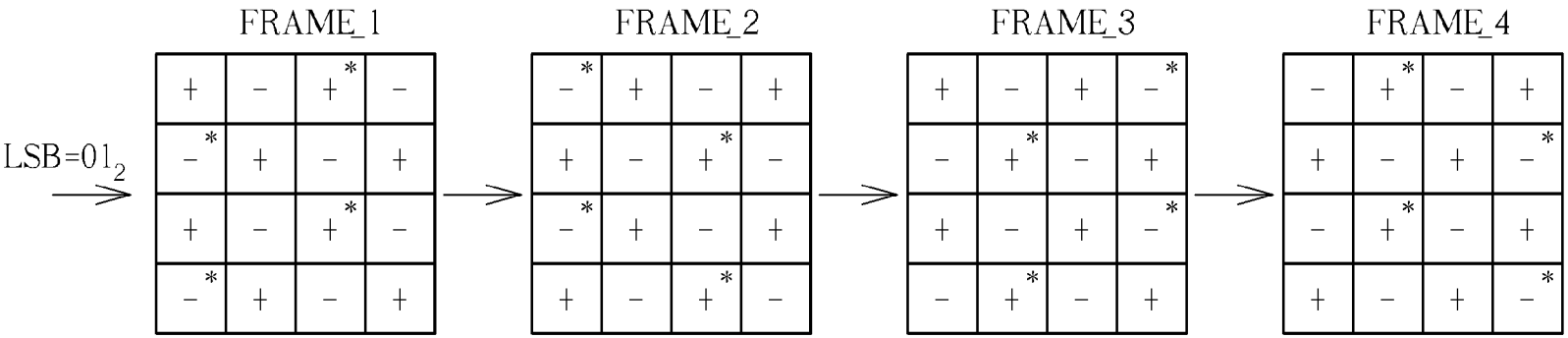
FIG. 5A to 5C illustrate schematic diagrams of the polarity and add-vale diagrams of a dot inversion LCD device according to an embodiment of the present invention.
Figure 5B:
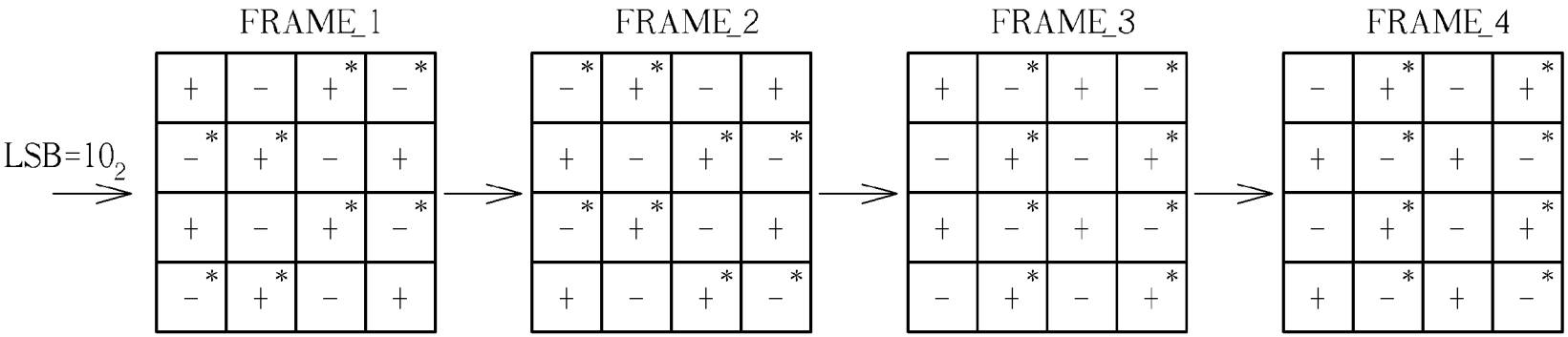
Figure 5C:
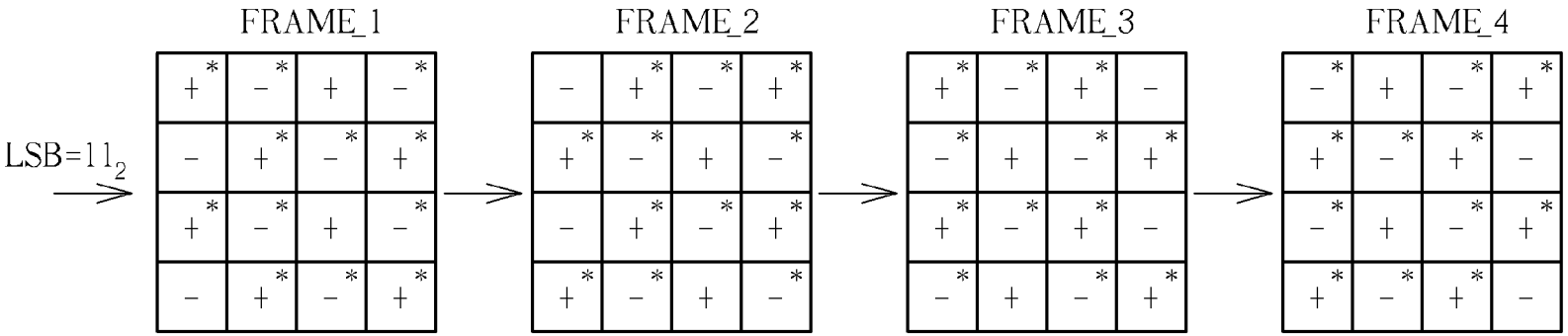

It is then understandable from the above description that the present invention can utilize the image blocks and the positive/negative polarity distribution of the LCD device to deduce all the usable polarity and add-value diagrams. Please refer to FIG. 5A to 5C, which illustrate schematic diagrams of the polarity and add-value diagrams of a dot inversion LCD device according to an embodiment of the present invention. For simplicity, FIG. 5A to 5C utilize the 4×4 matrices of pixels to illustrate how to determine the positions of the add-value pixels in the pictures FRAME_1~FRAME_K from the polarity distribution of the LCD device. Inside the figures, the symbol (*) represents the pixels designated as add-value pixels, the symbol (+) represents the display element is of positive polarity, and the symbol (−) represents the display element is of the negative polarity. To be detailed, FIG. 5A illustrates the time evolution of the add-value distribution when the LSB equals $0_{12}$. FIG. 5B illustrates the time evolution of the add-value distribution when the LSB equals $10_2$. FIG. 5C illustrates the time evolution of the add-value distribution when the LSB equals $11_2$. Noteworthily, the polarity distributions of the LCD device are also evolving with time. For example, inside FIG. 5A and 5C, pictures Frame_1 and Frame_3 are of the same polarity distribution, and pictures Frame_2 and Frame_4 are of the same distribution, and differ from the distributions of Frame_1 and Frame_3.

Figure 6A:
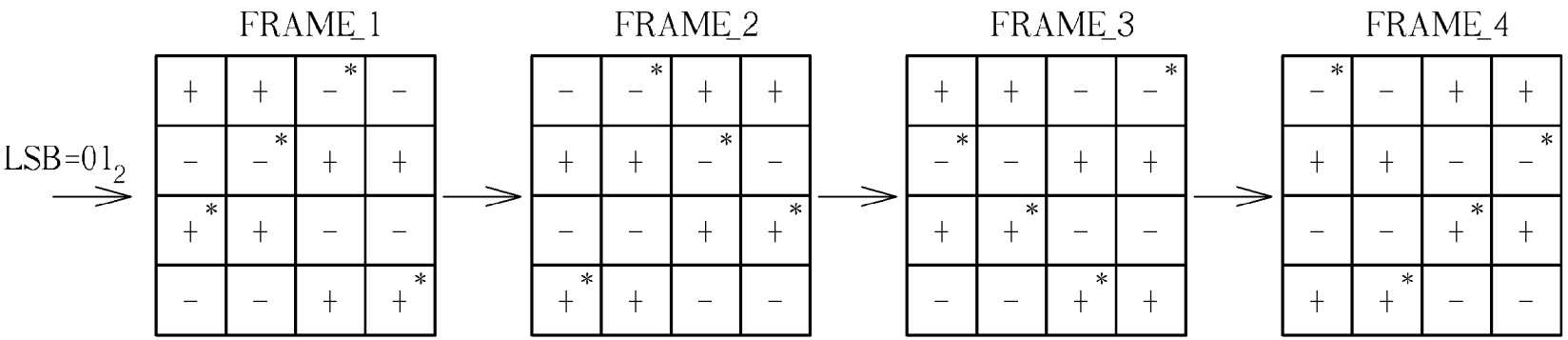
FIG. 6A to 6C illustrate schematic diagrams of the polarity and add-vale diagrams of a two-dot inversion LCD device according to an embodiment of the present invention.
Figure 6B:
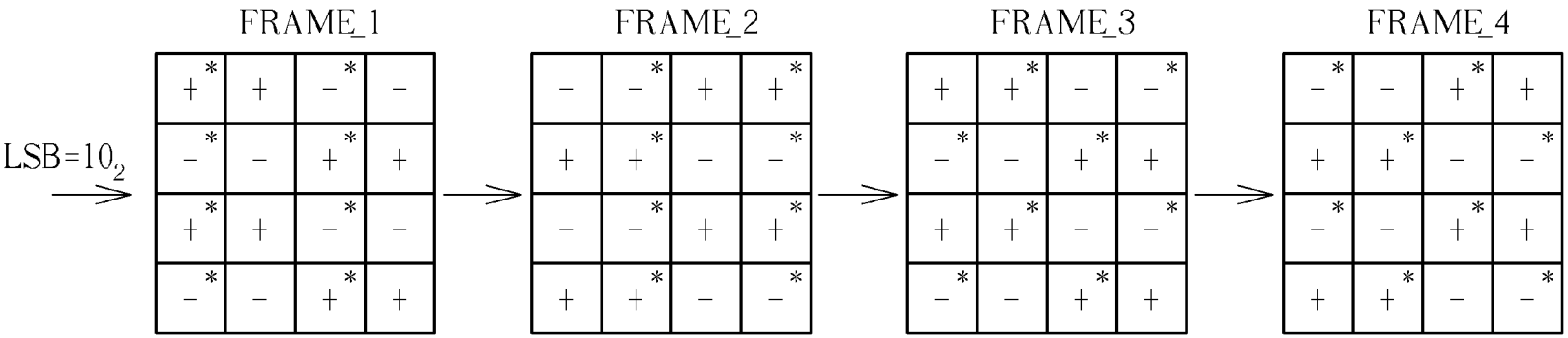
Figure 6C:
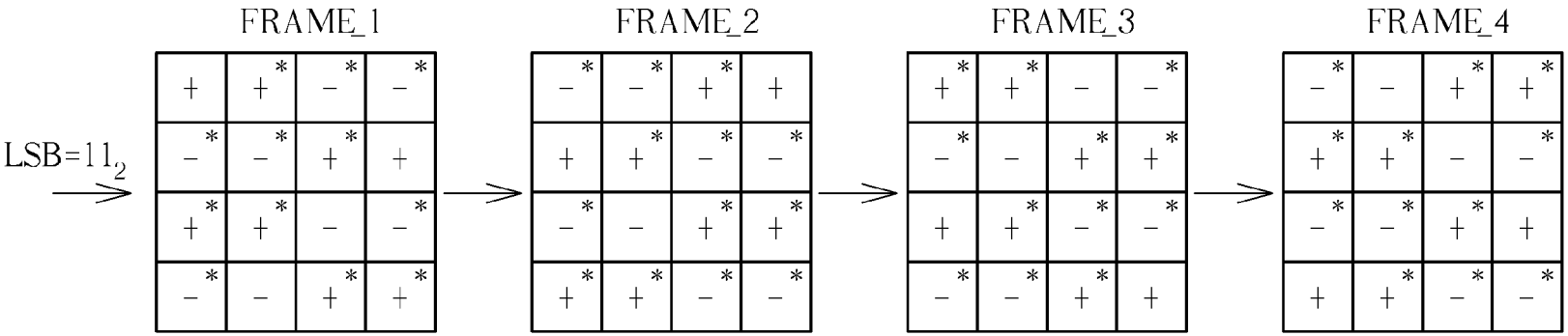

Please refer to FIG. 6A to 6C, which illustrate schematic diagrams of the polarity and add-value diagrams of a two-dot inversion LCD device according to an embodiment of the present invention. The symbols and their meanings used in FIG. 6A to 6C are made to follow those in FIG. 5A to 5C for clarity and simplicity. From the diagrams disclosed in FIG. 5A to 5C and FIG. 6A to 6C, the present invention can be used to increase 2 bits of grey levels, and when the polarity distribution differs for different LCD panels, the positions of the add-value pixels will be changed accordingly. From the description above, people of ordinary skills in the field should immediately recognize that the method disclosed in the present invention is readily applicable to other polarity distribution other than the dot-inversion LCD or two-dot inversion LCD devices. People of ordinary skills in the field should also immediately recognize that the polarity and add-value distribution is also applicable to image blocks including other amounts of pixels, and organized in other types of matrices. For example, the polarity add-value distribution can include only 4 pixels and represented as 2×2 square matrices, and are for increasing the grey levels by only 1 bit. Otherwise, the polarity add-value distribution can include 8 pixels and represented as 4×2 rectangular matrices. After all, people of ordinary skills in the field should also immediately recognize that the principles disclosed in the present invention can be applied to increase grey levels with different number of bits.

According to the present invention, when the number of bits accepted by the LCD panel is less than the number of bits of the input image, the image display method 40 can be utilized to increase the number of the bits of the grey levels. From the above example, when the input image is of 8 bits of grey levels, and the LCD panel can only accept display data of 6 bits of grey levels, then the image display method 40 can be utilized to increase the grey levels effectively. If the LCD device is a dot inversion LCD device, then the grey levels can be increased by 2 bits by using the method illustrated in FIG. 5A to 5C. If the LCD device is a two-dot inversion LCD device, then the grey levels can be increased by 2 bits by using the method illustrated in FIG. 6A to 6C. Therefore, the present invention can diminish the flickering phenomena and increase the picture quality by properly arranging the polarity and add-value distribution according to the polarity of the add-value pixels.

Figure 1:
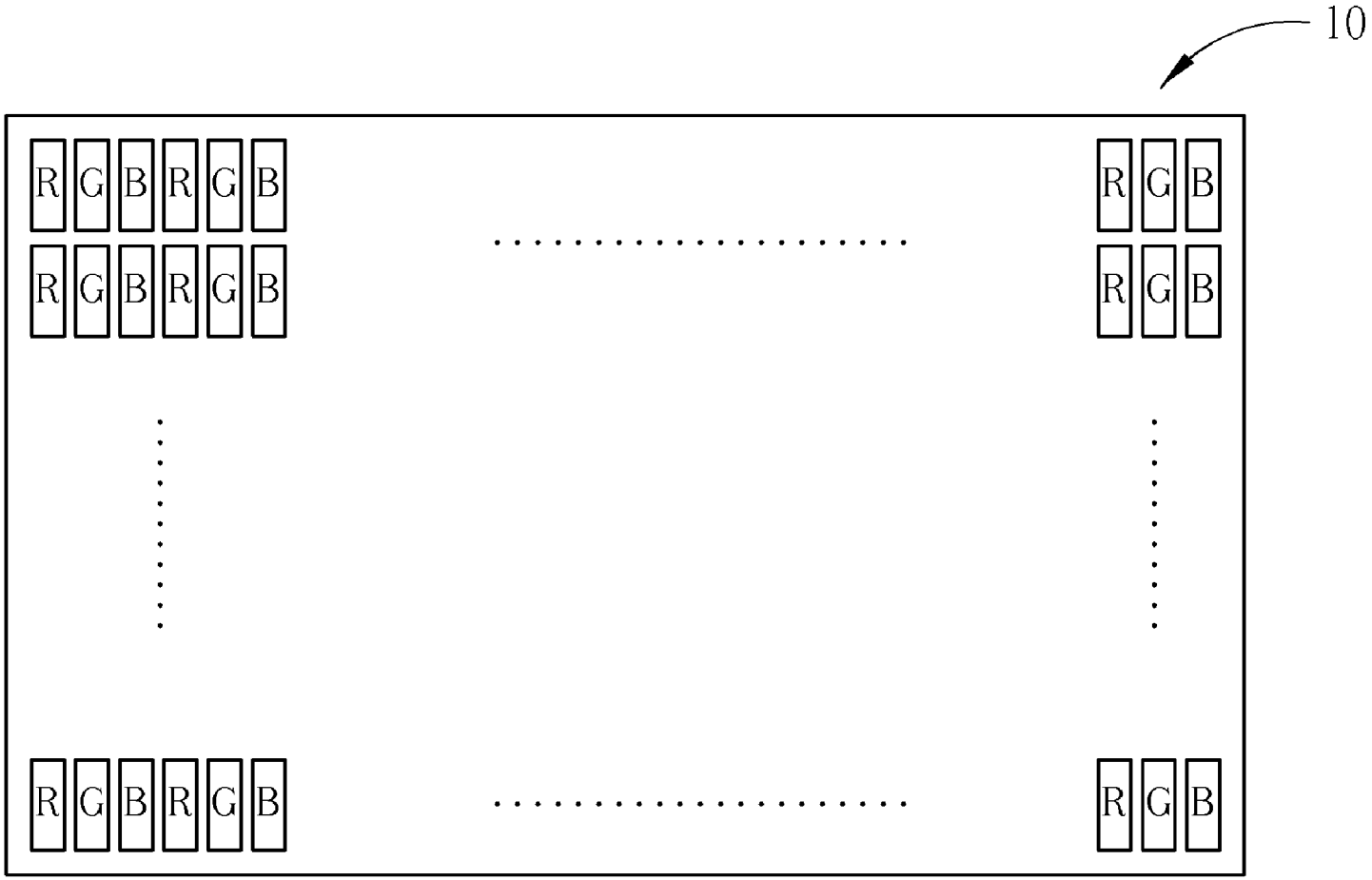
FIG. 1 PRIOR ART
FIG. 1 illustrates a schematic diagram of the display elements located in a liquid crystal display device according to the prior art.
Figure 2A:
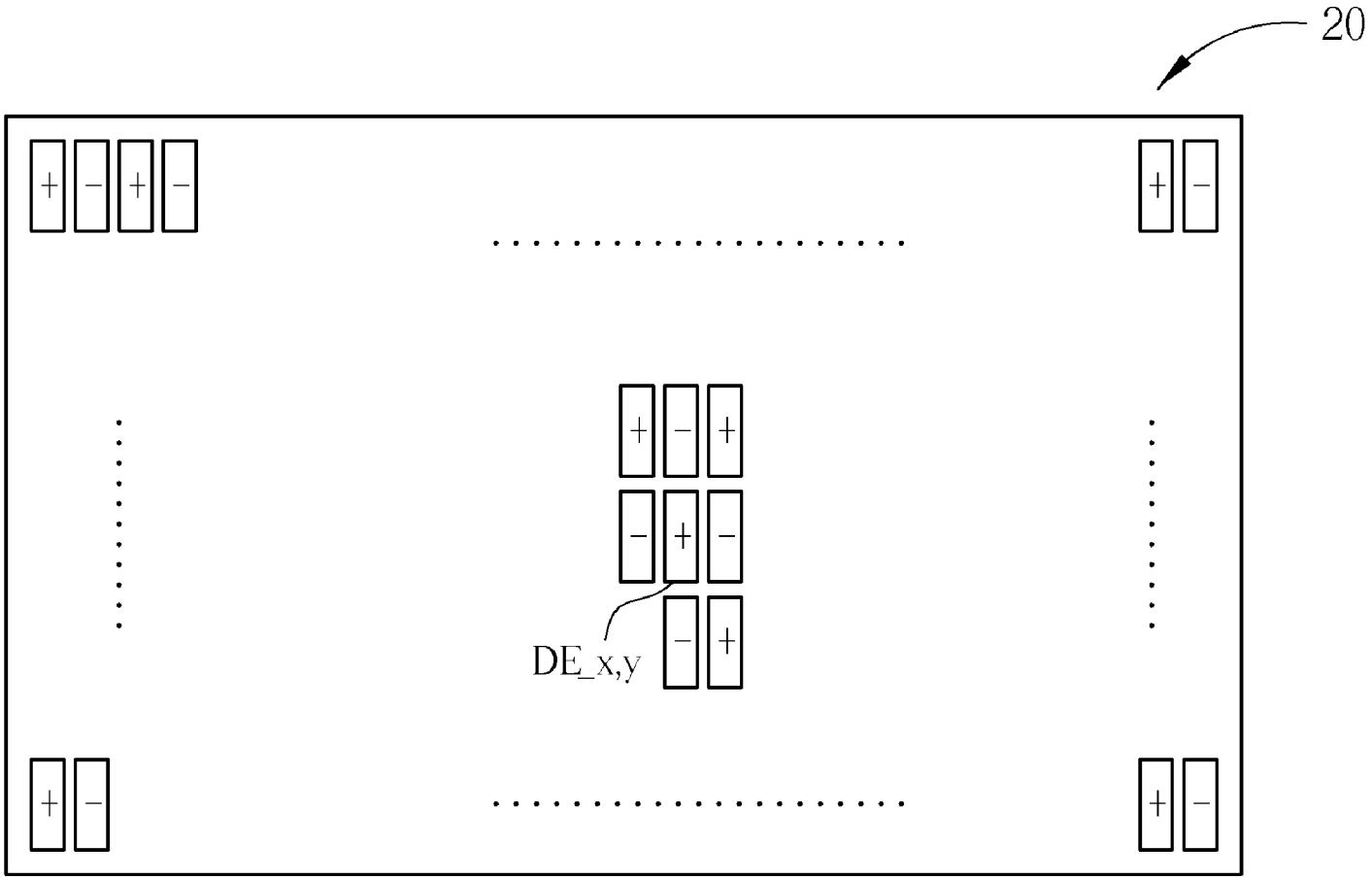
FIG. 2A PRIOR ART
FIG. 2A and FIG. 2B illustrate schematic diagrams of a dot inversion liquid crystal display device and the polarity distribution of its display elements.
Figure 2B:
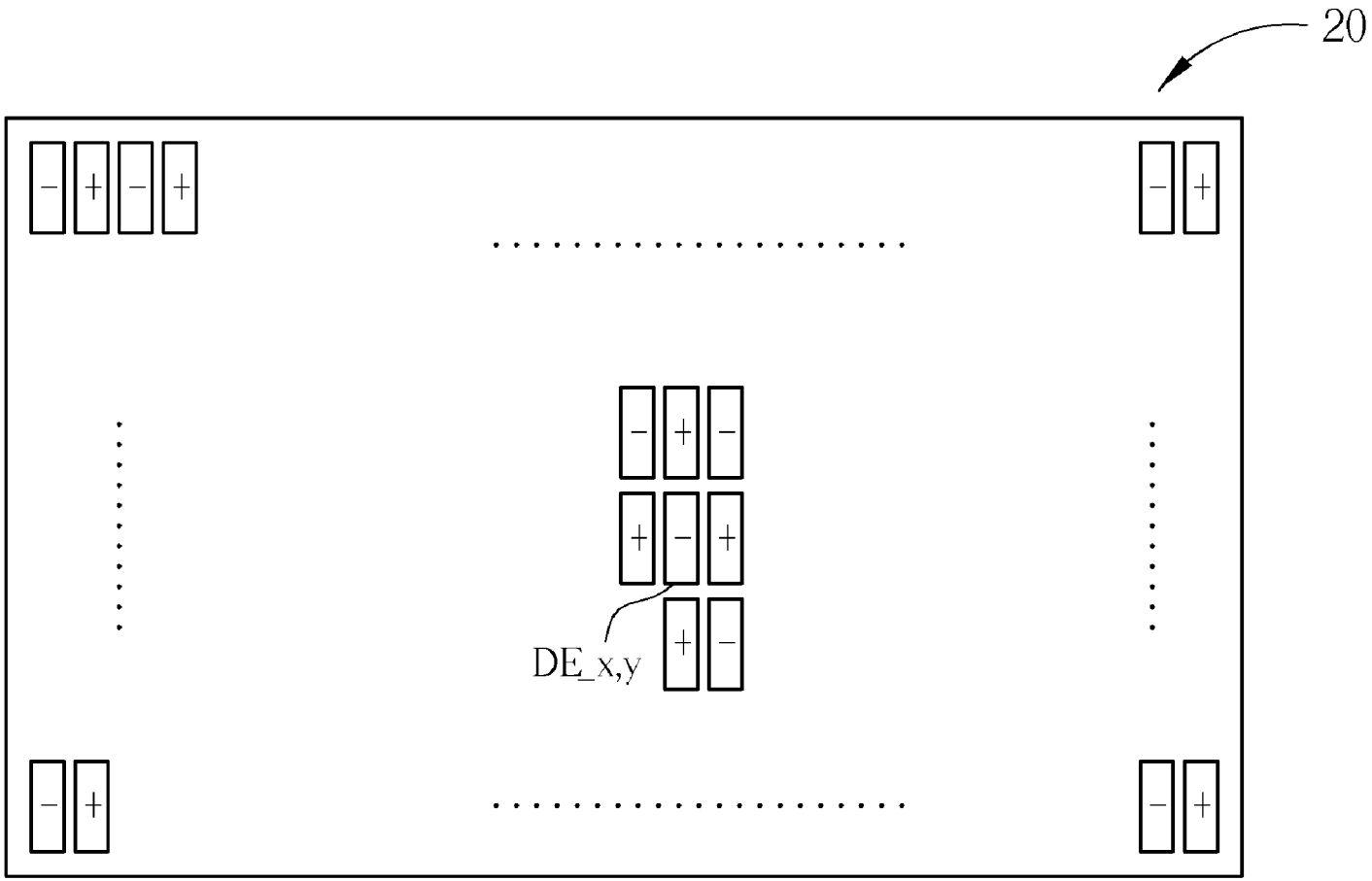
FIG. 2B PRIOR ART
Figure 3A:
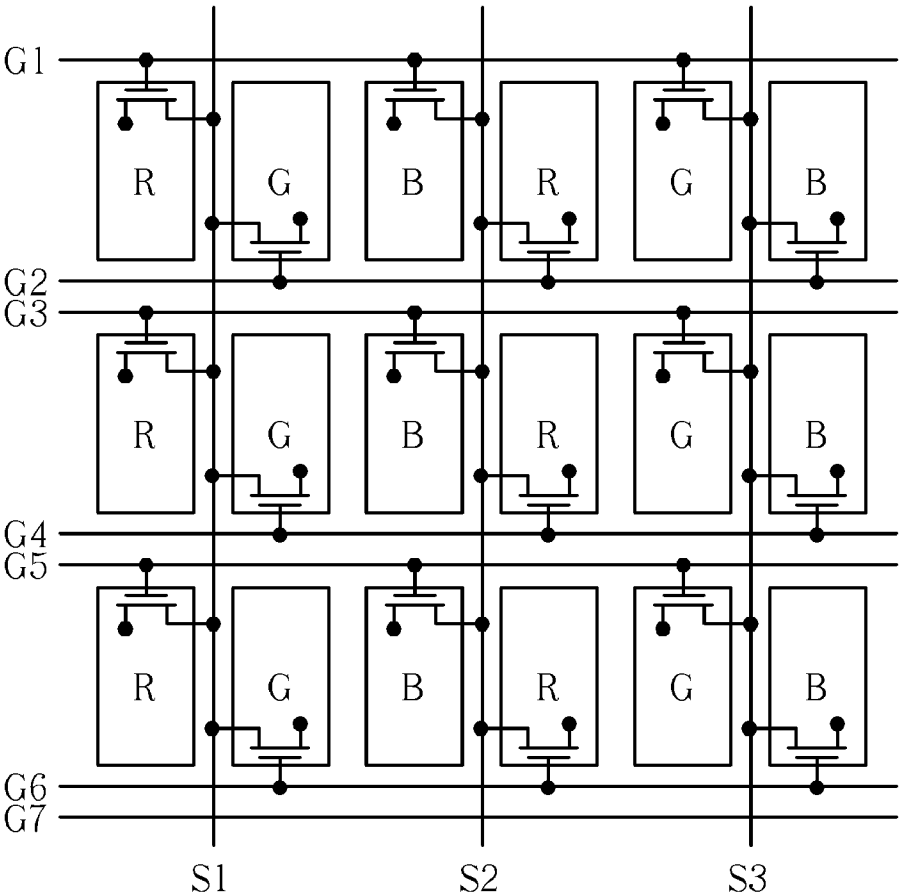
FIG. 3A PRIOR ART
FIG. 3A illustrates a schematic diagram of a two-dot inversion liquid crystal display device and its display elements.
Figure 3B:
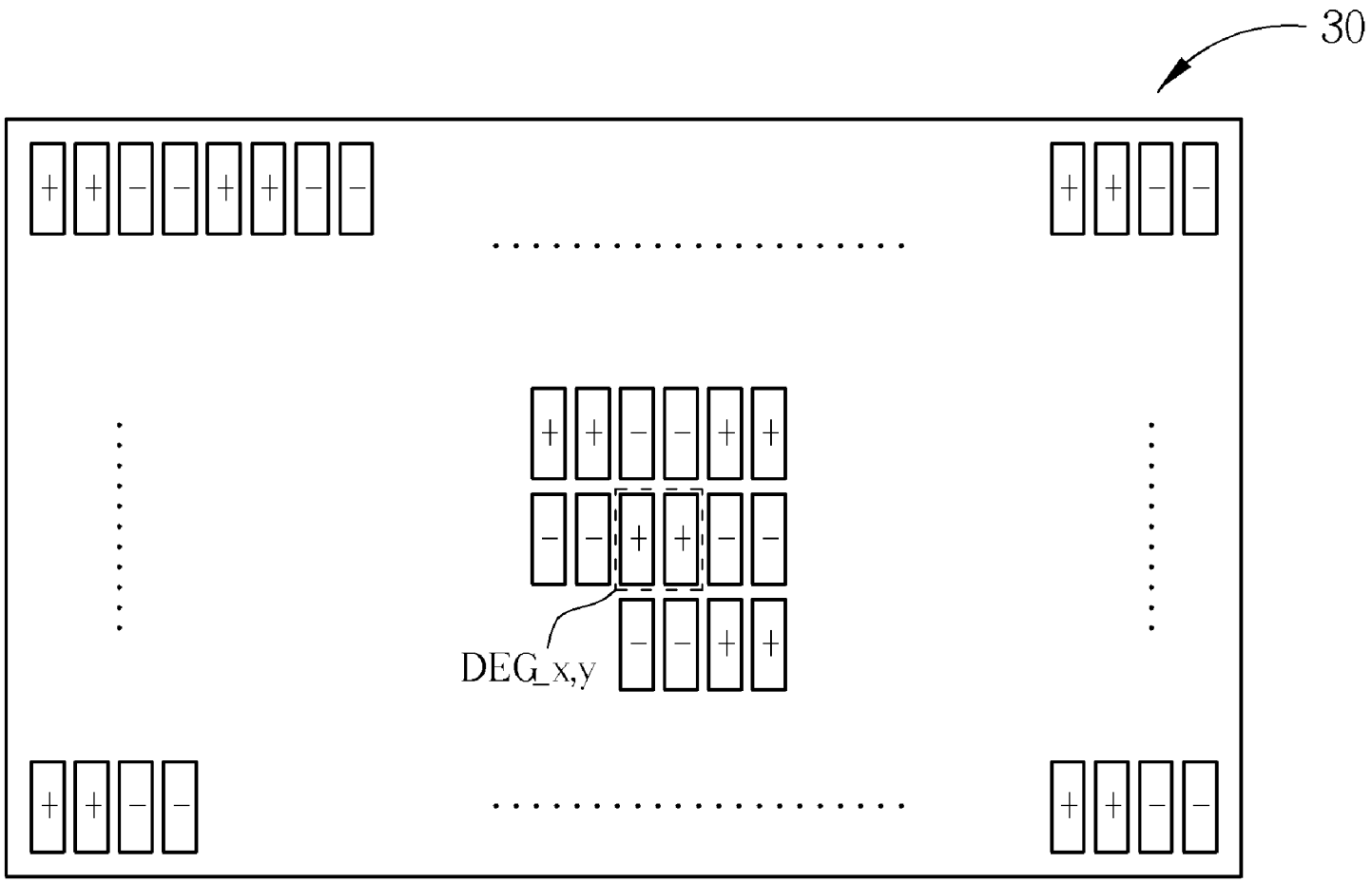
FIG. 3B PRIOR ART
FIG. 3B and FIG. 3C illustrate schematic diagrams of a two-dot inversion liquid crystal display device and the polarity distribution of its display elements.
Figure 3C:
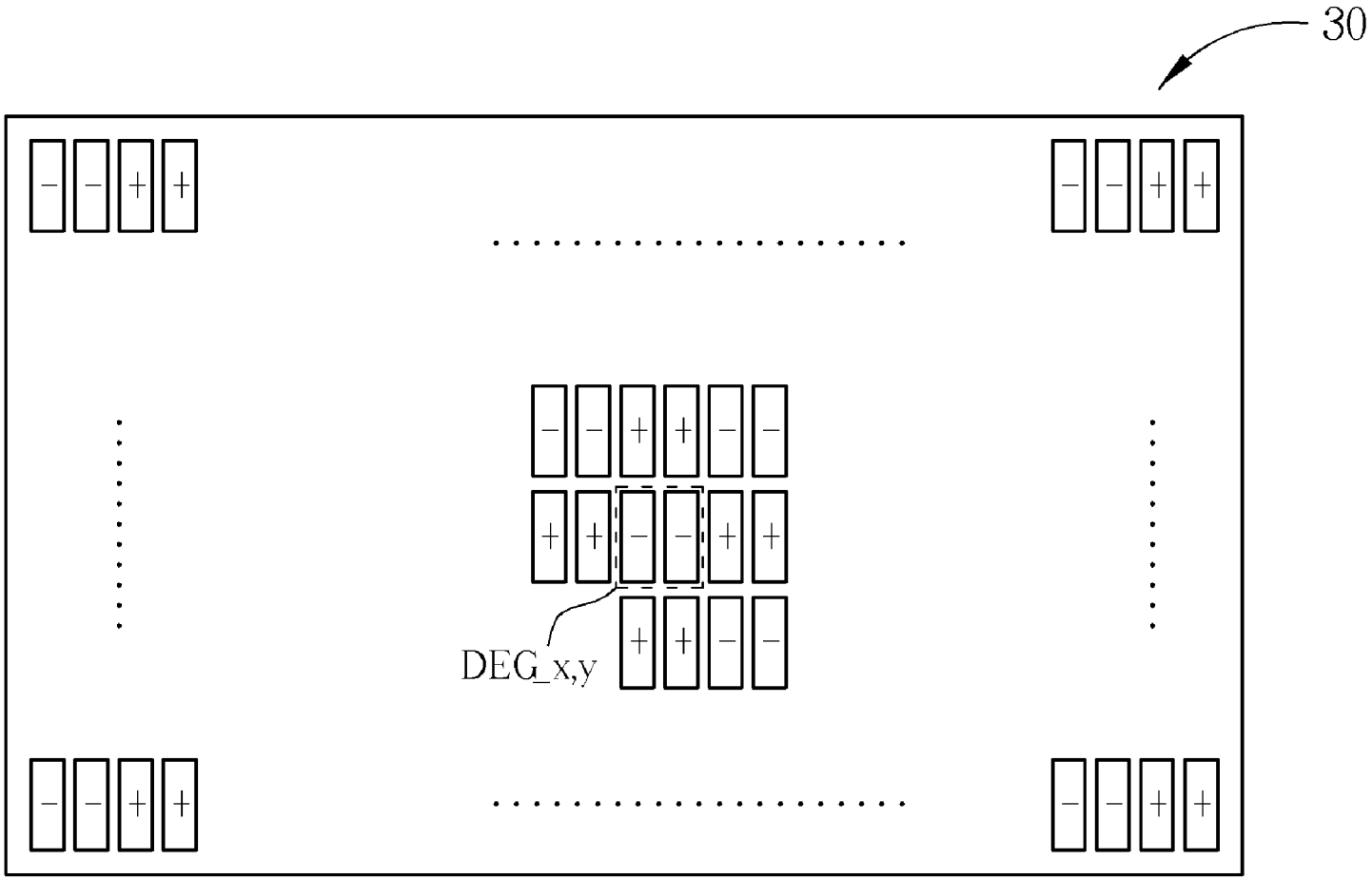
FIG. 3C PRIOR ART
Figure 3D:
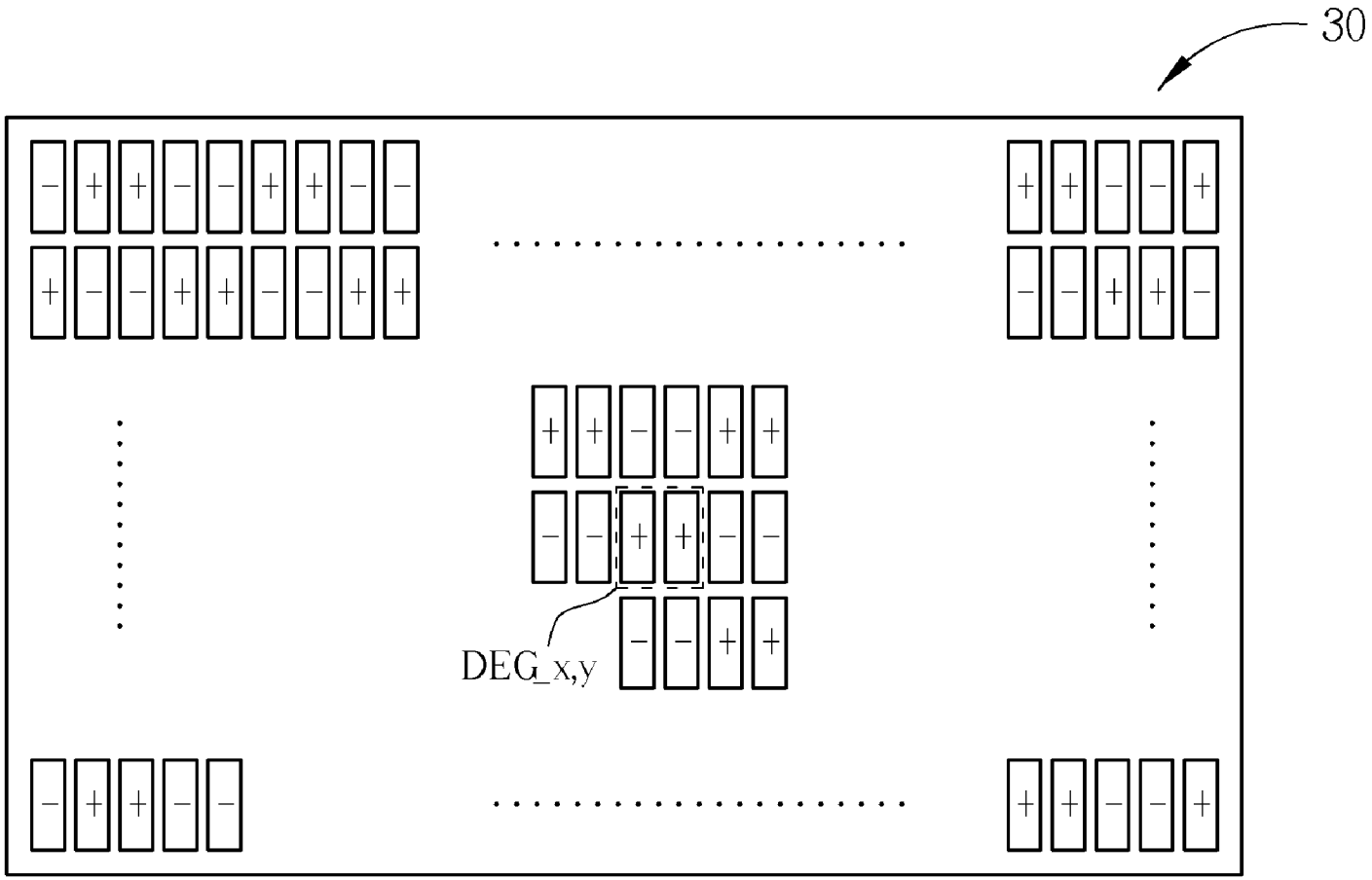
FIG. 3D PRIOR ART
FIG. 3D and FIG. 3E illustrate schematic diagrams of a two-dot inversion liquid crystal display device with irregular polarity distribution on the boundary of the LCD panel.
Figure 3E:
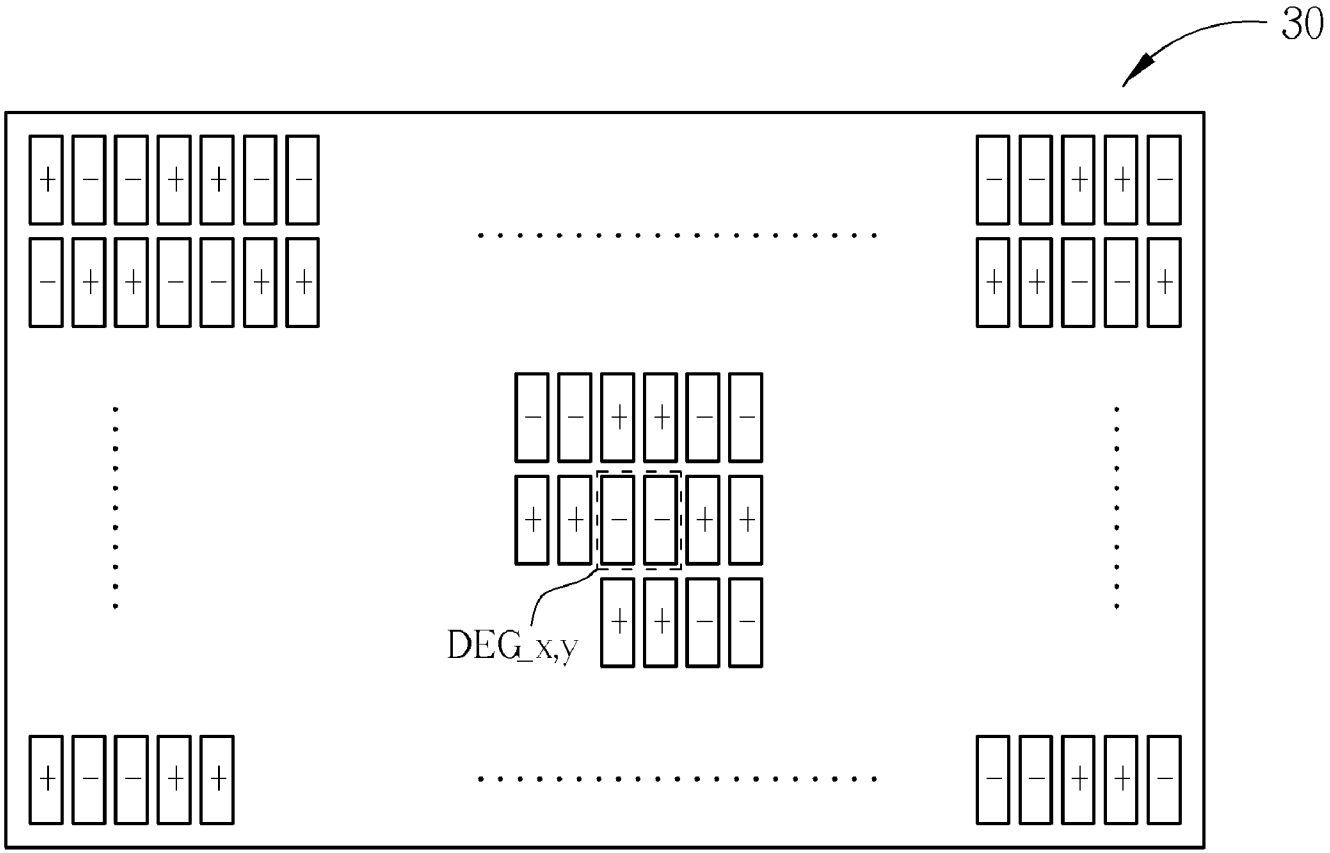
FIG. 3E PRIOR ART

On the other hand, and noteworthily, as mentioned in FIGS. 3D and 3E, on the boundary portion of the LCD device, a single display element can be taken as a group. Under this condition, the present invention can also utilize the image display method 40 to count from the boundary part of the image and to divide the whole image into blocks Block_l~Block_n. And, in each of the blocks, the present invention enforces the add-vale pixels to be equally distributed between display elements of positive polarity and negative polarity. Other than the boundary portion of the LCD panel, a group of the same polarity is not necessary to be divided into the same image block Block_x.

Figure 7A:
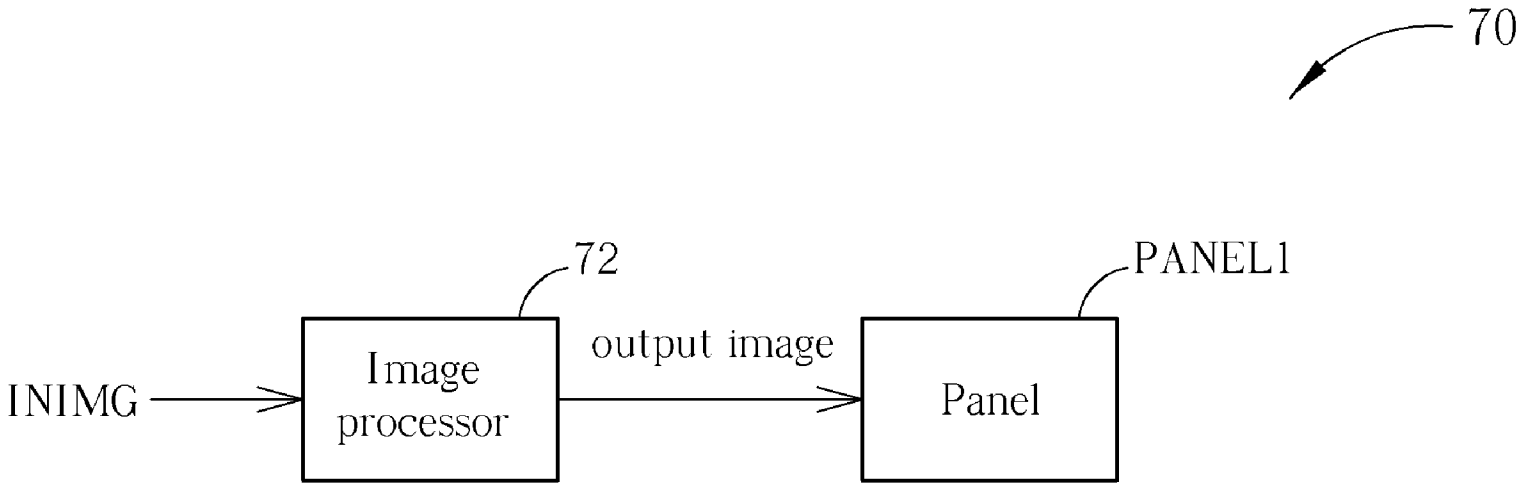
FIG. 7A illustrates a schematic diagram of a liquid crystal display device according to the present invention.
Figure 7B:
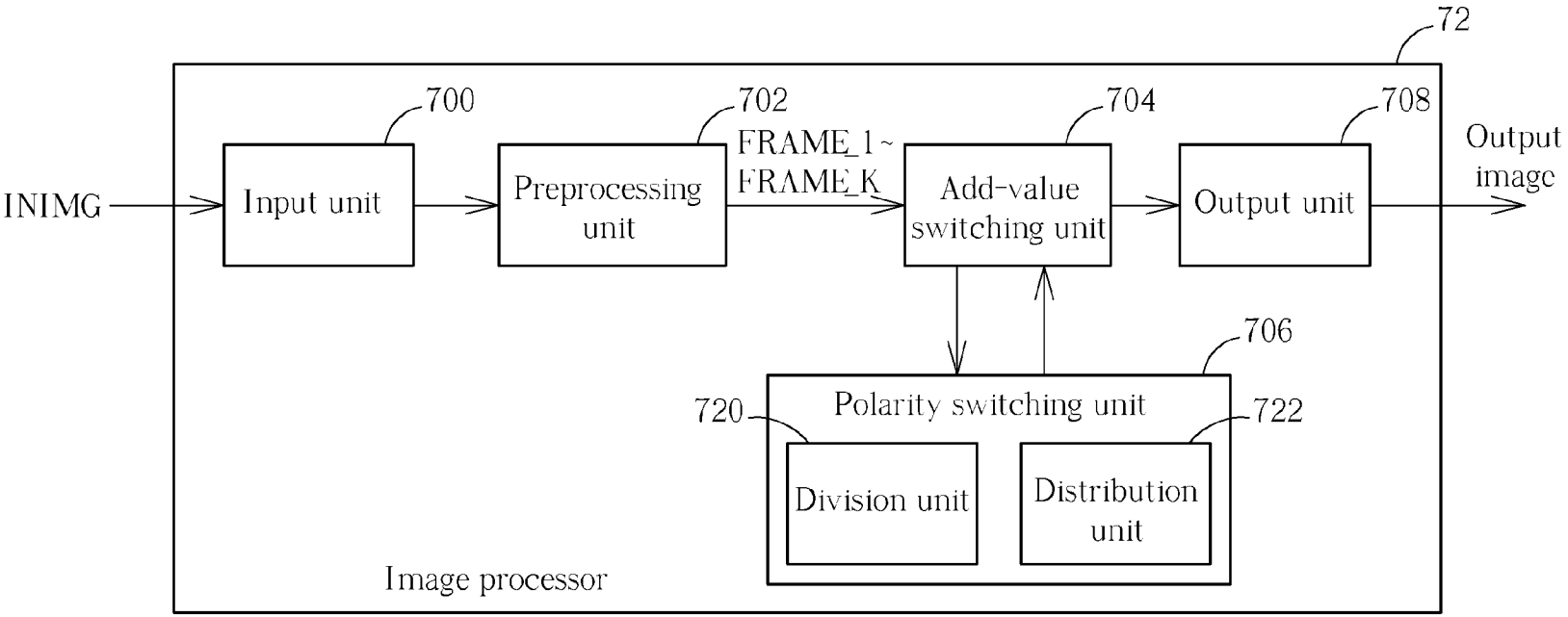
FIG. 7B illustrates a schematic diagram of an image processor according to the present invention.

About the realization of the image display method 40, please refer to FIG. 7A, which illustrates a schematic diagram of a liquid crystal display device 70 according to the present invention. The liquid crystal display device 70 comprises a panel PANEL1 and an image processor 72. The panel PANEL1 comprises a number of display elements, and each display elements changes its polarity between a positive polarity and a negative polarity. The image processor 72 is used for performing functions specified in the image display method 40; as illustrated in FIG. 7B, the image processor 72 comprises an input unit 700, a preprocessing unit 702, an add-value switching unit 704 and a polarity switching unit 706, which are used to perform the functions specified in STEP 402, 404, 406 and 408, respectively. Furthermore, the operating principles and other details of the image processor 72 can be found in the description above; for example, the polarity switching unit 706 comprises a division unit 720 and a distribution unit 722. The division unit 722 is used to divide the consecutive pictures FRAME_1~FRAME_K into blocks, and the distribution unit 722 is to enforce the number of the add-value pixels of a positive polarity to be close to the number of add-value pixels of a negative polarity for the pictures FRAME_1~FRAME_K, according to the number of add-value pixels and the polarity of the corresponding display element. On the other hand, the image processor 72 also comprises an output unit 708, for outputting the pictures FRAME_1~FRAME_K to the LCD panel PANEL1 to display these consecutive pictures.

According to the experiment, if the liquid crystal display device only applies the averaging effect (of the visual persistence) to increase number of grey levels by fast changing pixel data (as depicted in STEP 404, 406 of the present invention), and not considers the polarity distribution of the display elements in the spatial domain (like the one specified in STEP 408), then the flicker phenomena will be very obvious. However, via the image display method 40, the present invention can increase the grey levels of the liquid crystal display device without replacing a panel device, and can reduce the unpleasant flickering effect, such that the convenience of user can be greatly advanced.

In summary, the present invention cannot only display the least significant bits of the grey level by modulating the add-value pixels in the temporal domain, but also reduce the image flickering phenomena by specifying the add-value pixels in the spatial domain.

Those skilled in the art will readily observe that numerous modifications and alterations of the device and method may be made while retaining the teachings of the invention.

What is claimed is:

1. An image processor for improving an image quality of a liquid crystal display (LCD) device, a panel of the LCD device having a plurality of display elements each switching between a positive polarity and a negative polarity, the image processor comprising:

an input unit, for receiving an input image comprising a plurality of input image sub-pixels corresponding to a plurality of display elements;

a preprocessing unit, for generating a plurality of consecutive pictures of a predefined period number according to the input image, wherein a gray level of the input image is greater than a gray level of the plurality of consecutive pictures;

an add-value switching unit, for setting a number of pixels required for adding a value among the plurality of consecutive pictures for every display element according to a least significant bits (LSB) of a pixel of the input image; and a polarity switching unit, for enforcing the number of add-value pixels of a positive polarity to be closed to the number of add-value pixels of a negative polarity according to the number of add-value pixels in each of the plurality of consecutive pictures and the polarity of the corresponding display element.

2. The image processor of claim 1 further comprising an output unit for displaying the plurality of consecutive pictures via the panel of the LCD device.

3. The image processor of claim 1, wherein the panel of the LCD device is a two-dot inversion LCD panel.

4. The image processor of claim 1, wherein the panel of the LCD device is a dual gate LCD panel.

5. The image processor of claim 1, wherein the polarity switching unit comprises:

a division unit, for dividing the plurality of consecutive pictures into a plurality of image blocks; and a distribution unit, for enforcing the number of the add-value pixels of the positive polarity to be close to the number of the add-value pixels of the negative polarity in each block of each picture according to the number of the add-value pixels in each of the plurality of consecutive pictures and the polarity of the corresponding display element.

6. The image processor of claim 5, wherein each block of the plurality of blocks is a square.

7. The image processor of claim 5, wherein each block of the plurality of blocks is a rectangle.

8. A liquid crystal display (LCD) device comprising:

a panel comprising a plurality of display elements each switching between a positive polarity and a negative polarity; and an image processor comprising:

an input unit, for receiving an input image comprising a plurality of input image sub-pixels corresponding to a plurality of display elements;

a preprocessing unit, for generating a plurality of consecutive pictures of a predefined period number according to the input image, wherein a gray level of the input image is greater than a gray level of the plurality of consecutive pictures;

an add-value switching unit, for setting a number of pixels required for adding a value among the plurality of consecutive pictures for every display element according to a least significant bits (LSB) of a pixel of the input image; and a polarity switching unit, for enforcing the number of add-value pixels of a positive polarity to be closed to the number of add-value pixels of a negative polarity according to the number of add-value pixels in each of the plurality of consecutive pictures and the polarity of the corresponding display element.

9. The liquid crystal display (LCD) device of claim 8 further comprising an output unit for displaying the plurality of consecutive pictures via the panel of the LCD device.

10. The liquid crystal display (LCD) device of claim 8, wherein the panel of the LCD device is a two-dot inversion LCD panel.

11. The liquid crystal display (LCD) device of claim 8, wherein the panel of the LCD device is a dual gate LCD panel.

12. The liquid crystal display (LCD) device of claim 8, wherein the polarity switching unit comprises:

a division unit, for dividing the plurality of contiguous pictures into a plurality of image blocks; and a distribution unit, for enforcing the number of the add-value pixels of the positive polarity to be close to the number of the add-value pixels of the negative polarity in each block of each picture according to the number of the add-value pixels in each of the plurality of consecutive pictures and the polarity of the corresponding display element.

13. The liquid crystal display (LCD) device of claim 12, wherein each block of the plurality of blocks is a square.

14. The liquid crystal display (LCD) device of claim 12, wherein each block of the plurality of blocks is a rectangle.

15. A method for improving an image quality of a liquid crystal display (LCD) device, a panel of the LCD device having a plurality of display elements each switching between a positive polarity and a negative polarity, the method comprising:

receiving an input image comprising a plurality of input image sub-pixels corresponding to a plurality of display elements;

generating a plurality of consecutive pictures of a predefined period number according to the input image, wherein a gray level of the input image is greater than a gray level of the plurality of consecutive pictures;

setting a number of pixels required for adding a value among the plurality of consecutive pictures for every display element according to a least significant bits (LSB) of a pixel of the input image; and enforcing the number of add-value pixels of a positive polarity to be close to the number of add-value pixels of a negative polarity according to the number of add-value pixels in each of the plurality of consecutive pictures and the polarity of the corresponding display element.

16. The method of claim 15 further comprising displaying the plurality of consecutive pictures via the panel of the LCD device.

17. The method of claim 15, wherein the panel of the LCD device is a two-dot inversion LCD panel.

18. The method of claim 15, wherein the panel of the LCD device is a dual gate LCD panel.

19. The method of claim 15, wherein enforcing the number of the add-value pixels of the positive polarity to be close to the number of the add-value pixels of the negative polarity according to the number of the add-value pixels in each of the plurality of consecutive pictures and the polarity of the corresponding display element comprises:

dividing the plurality of consecutive pictures into a plurality of image blocks; and enforcing the number of the add-value pixels of the positive polarity to be close to the number of add-value pixels of the negative polarity in each block of each picture according to the number of the add-value pixels in each of the plurality of contiguous pictures and the polarity of the corresponding display element.

20. The method of claim 19, wherein each block of the plurality of blocks is a square.

21. The method of claim 19, wherein each block of the plurality of blocks is a rectangle.

* * * * *